United States Patent [19]

Graffin

[11] Patent Number: 4,741,144

[45] Date of Patent: May 3, 1988

[54] COMPOSITE STRUCTURAL BEAM

[76] Inventor: Andre Graffin, Le Tremblay-Omonville, 27110, Le Neubourg, France

[21] Appl. No.: 922,467

[22] Filed: Oct. 23, 1986

[30] Foreign Application Priority Data

Oct. 31, 1985 [FR] France ..... 85 16179

[51] Int. Cl.[4] ..... E04C 3/34; E04C 3/20

[52] U.S. Cl. ..... 52/725; 52/423; 52/724; 52/727; 52/741

[58] Field of Search ..... 52/724, 725, 727, 372, 52/423, 425, 741

[56] References Cited

U.S. PATENT DOCUMENTS

| | | | |
|---|---|---|---|
| 250,878 | 12/1981 | Brush . | |
| 1,533,099 | 4/1925 | Carroll . | |
| 1,792,040 | 2/1931 | Schaub | 52/372 X |
| 3,304,674 | 2/1967 | Ward | 52/425 X |
| 3,634,990 | 1/1972 | Pugh . | |
| 4,503,648 | 3/1985 | Mahaffey . | |

FOREIGN PATENT DOCUMENTS

| | | | |
|---|---|---|---|
| 0051319 | 5/1982 | European Pat. Off. . | |
| 0062139 | 10/1982 | European Pat. Off. . | |
| 111103 | 6/1900 | Fed. Rep. of Germany | 52/372 |
| 2226323 | 8/1973 | Fed. Rep. of Germany . | |
| 2931162 | 2/1981 | Fed. Rep. of Germany . | |
| 348209 | 4/1905 | France . | |
| 893659 | 8/1944 | France . | |
| 2479877 | 10/1981 | France . | |
| 2485594 | 12/1981 | France . | |
| 210311 | 7/1940 | Switzerland . | |

*Primary Examiner*—Alfred C. Perham

*Attorney, Agent, or Firm*—Burns, Doane, Swecker & Mathis

[57] ABSTRACT

Composite beam of polygonal cross-section comprises wooden external walls and a core of a material, such as concrete, providing the beam with its mechanical strength. The walls comprise flat elements assembled by means of bonded groove and tongue corner joints. Screws are embedded partially in the walls and partially in the core to bond the walls to the core.

13 Claims, 2 Drawing Sheets

COMPOSITE STRUCTURAL BEAM

BACKGROUND AND OBJECTS OF THE INVENTION

The present invention relates to a composite beam of polygonal cross-section comprising wooden external walls and a core of a material providing the beam with its mechanical strength.

Composite beams are known which are comprised of a hollow metal shape faced on the external surfaces with wood trim (see German Patent No. 30 41 585). This composite system has only the mechanical strength of its internal shape, the wooden elements being necessary mainly for esthetic reasons. Furthermore, there are always empty spaces remaining at the corners which permit the accumulation of dust.

U.S. Pat. No. 250,878 concerns composite beams comprising a wooden frame formed of particle board panels surrounding a space of square cross-section filled with polyurethane foam which is intended to bond together the panel assembly, rigidify the structure and prevent the penetration of humidity into the hollow space present between the panels. Such beams have, at most, the mechanical strength of solid wood beams but do not have the esthetic qualities of the latter.

There are also known quadrangular hollow beams according to German Publication No. P 29 31 162.4-25, which comprise metal external walls assembled from four external elements, with the internal space subsequently filled with concrete and with a plurality of hooks welded to the inside of the walls to provide a strong bond between the concrete and the external panels. Beams of this type are very strong mechanically, but do not have the esthetic quality of wood.

An object of the present invention is to provide a high strength composite beam formed of external wood parts having an excellent appearance.

SUMMARY OF PREFERRED EMBODIMENTS OF THE INVENTION

This object is achieved by a composite beam of polygonal cross-section, comprising wooden external walls and a core of a material providing the beam with its mechanical strength. The walls are composed of flat elements assembled by means of bonded groove-and-tongue joints at the corners so as to leave an empty space inside the walls for the core. The core may comprise concrete poured into the space between the walls. A rigid bond between the walls and the concrete is created by means of threaded fasteners such as screws embedded partially in the wooden walls and partially in the core. The screws are preferably distributed regularly, most preferably in zigzag fashion, and are located close enough together to resist deformation of the walls.

BRIEF DESCRIPTION OF THE DRAWING

The invention will become more apparent from the figures attached hereto, in which:

FIG. 3 is a partial side view illustrating an embodiment of the end portion of the beam of the present invention.

DETAILED DESCRIPTION OF PREFERRED EMBODIMENTS OF THE INVENTION

Figure 1:
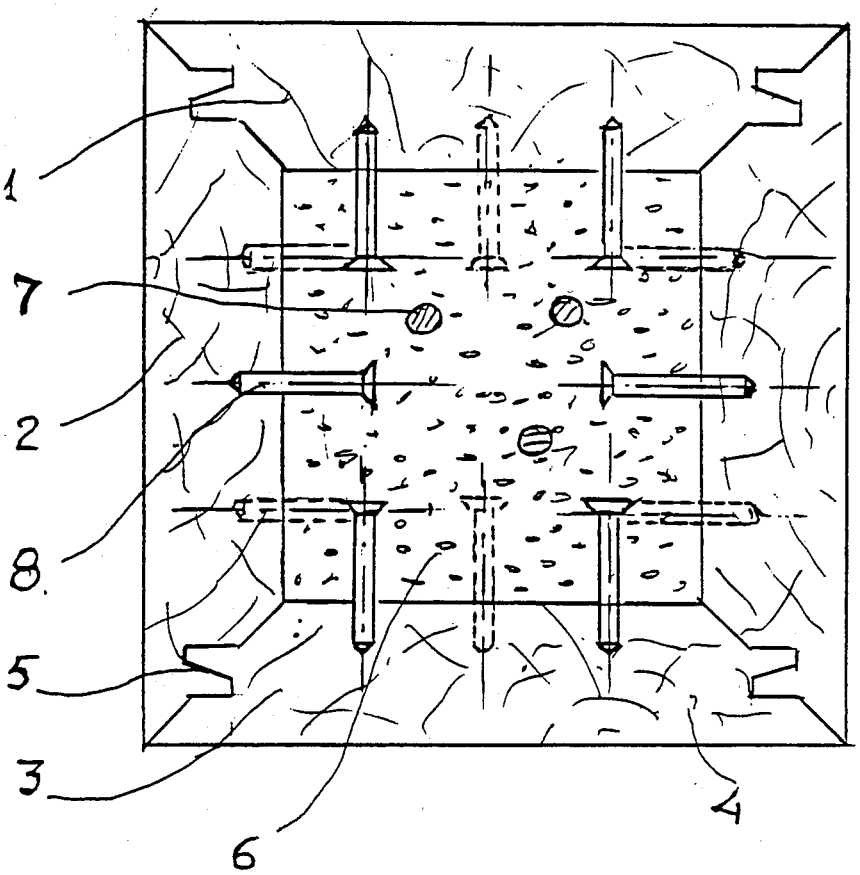
FIG. 1 is a cross-sectional view through a composite beam according to a more preferred embodiment of the invention, the core of which comprises concrete.

The beam shown in FIG. 1 comprises four wall elements 1, 2, 3, 4 formed of a hard wood, for example oak, assembled by means of grooves with adhesively bonded groove and tongue corner joints 5. Prior to the assembly of the four wall elements, a plurality of helically threaded fasteners, such as screws 8 is partially embedded in the wood. The screws are placed at a relatively short distance from each other, for example 5 cm from axis to axis. To obtain good distribution, the screws may be placed in a zigzag pattern over the entire height of the wall elements 1 to 4. Following the adhesive bonding and drying of the walls 1–4 equipped with these screws, concrete 6 is poured into the space between the walls. The pouring is performed with accurate metering so as to introduce a minimum amount of water. To drain off any excess water, the beam is placed vertically during and after the pouring, until the concrete has set. To increase the strength of the concrete core, it is advantageous to insert steel reinforcements 7 prior to pouring. After fabrication, the screws 8 are embedded partially in the wood walls and partially in the core to fasten the walls to the core. The concrete and wood occupy the grooves defined by the screw threads to enhance the bonding action.

Tests performed show that a beam produced in this manner readily withstands differences in both temperature and humidity. In particular, the wall elements, maintained fixedly by the anchorage comprised of the screws 8, cannot buckle under any condition. The appearance of such a beam remains better than that of a solid oak beam, as the latter always cracks along its length. The figure shows a square beam, but such a beam may be of non-square rectangular shape or any other polygonal shape desired. The figure also shows single piece wall elements, but this does not exclude the possibility that the wall elements may each comprise a plurality of juxtaposed pieces interconnected by means of bonded groove and tongue joints, the juxtaposition being effected by connections parallel to the axis of the beam, or perpendicular to the axis in the case of beams of great length.

Prior to the pouring of the concrete, at one of the ends of the beam or at both ends, temporary concrete forms may be provided which define extensions of the wall elements or which overlap the wall elements, thereby forming an extension of the concrete beyond the wall elements, making it possible for example to embed the thus-manufactured beam in soil to a height in the vicinity of the wooden wall elements, or to connect the beam with the reinforced concrete framework of a building. One end of the beam may be covered, after the pouring of the concrete, with a wood cover equipped with anchoring screws 8, and with joining grooves being bonded into the corresponding grooves of elements, such as 1 to 4, in a manner such as to achieve a pleasant appearance of the end.

Figure 2:
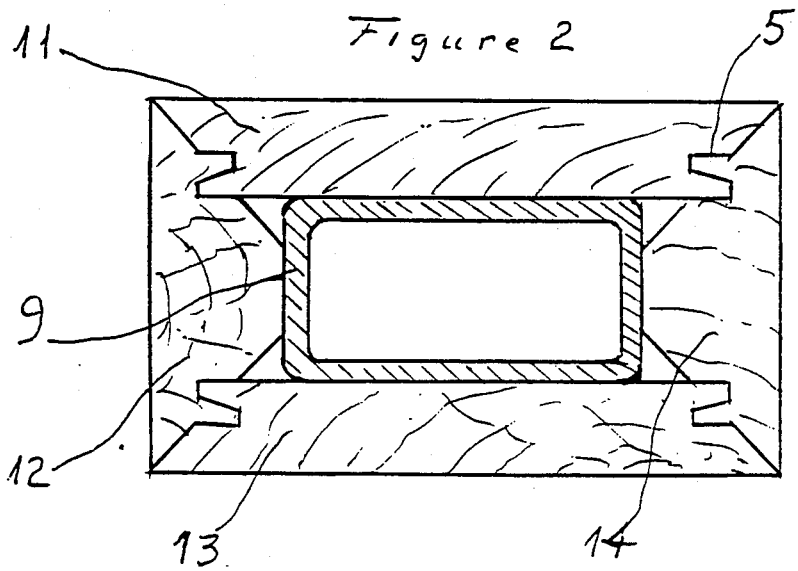
FIG. 2 is a cross-sectional view through a composite beam according to another embodiment of the invention, the core whereof comprises metal.

FIG. 2 shows another preferred embodiment of the beam according to the invention, in which the core of the beam comprises a hollow metal shape 9, around which are assembled wall elements 11, 12, 13, 14. The wall elements are connected by bonded groove and tongue corner joints 5. In this case, the joint between the core and the wall elements is obtained by adhesively bonding the walls to the core simultaneously with the bonding of the elements to each other. Similarly to the embodiment of FIG. 1, the cores may project beyond the wall elements at one or both ends of the beam, to enable the beam to be connected to other structural elements by welding or bolting. Furthermore, each of the walls may comprise one or several elements which are juxtaposed and assembled as described above.

Good results are obtained for composite beams of the type disclosed in connection with FIG. 1 by employing wall elements having thickness of 23 mm and utilizing screws of 25 mm length and 21 mm diameter embedded in each wall to a depth of 12 mm, placed in a zigzag pattern and spaced apart 50 mm, axis to axis.

If the core is made of concrete, the latter should not be poured earlier than 24 hours after the adhesive bonding of the wall elements to each other. After the pouring, the assembly should be allowed to stand in a sheltered and ventilated location, protected particularly against freezing, for at least 10 days.

If it is desired to assemble such composite beams with other elements, no notch of more than 12 mm must be applied in view of the presence of the screws. If other elements are to be mounted on the beam, they may be (depending on their nature and weight) screwed into the wood, or else, a hole may be drilled into the concrete and a plastic plug inserted therein.

If the composite beams are to be placed on the outside of a structure, they should be treated with a product such as "Forlane", including three preparatory layers and two finish coats. Resistance to the weather is then warranted for 10 years.

For certain applications, such as lintel beams, it is sufficient to cover two faces of the core, the two other faces being provided for the pouring of the concrete by a temporary covering.

The invention may be applied to the production of all types of beams, fence posts, gantry supports. Beams with metal cores may be used to produce sliding doors, truss frames or any element not requiring heavy cross-sections but in need of high mechanical strength.

Although the present invention has been described in connection with preferred embodiments thereof, it will be appreciated by those skilled in the art that modifications, substitutions, additions and deletions not specifically described may be made without departing from the spirit and scope of the invention as defined in the appended claims.

What I claim is:

1. An elongated composite beam of polygonal cross-section, comprising wooden external walls defining an internal space, and a core in the space, the core comprising a material providing the beam with at least a substantial of mechanical strength, a plurality of transversely extending threaded fasteners having a threaded portion embedded partially within each wall and a threaded portion partially within the core to fasten the walls to the core, and an axially extending metal reinforcing member within said core.

2. Composite beam according to claim 1, wherein the fasteners are distributed in a regular pattern.

3. Composite beam according to claim 2, wherein the fasteners are arranged in a zigzag pattern.

4. Composite beam according to claim 1, wherein each of the external walls comprises a flat element having corner groove and tongue structure, the walls being interconnected by joints defined by groove-and-tongue structure of mutually adjacent corners.

5. Composite beam according to claim 1, wherein the length of the core is greater than the length of the walls so that the core extends beyond the walls at least at one end of the beam.

6. Composite beam according to claim 1, wherein at least some of the walls each comprises several pieces interconnected by intermeshing groove-and-tongue structure which is adhesively bonded.

7. Composite beam according to claim 1, wherein said core is formed of concrete.

8. Composite beam according to claim 7, wherein said fasteners are distributed in a regular pattern.

9. Composite beam according to claim 8, wherein said fasteners comprise screws.

10. A method of forming an elongated composite beam of polygonal cross-section comprising the steps of:

partially inserting a plurality of threaded members into each of a plurality of elongated wall members so that a portion of each of the threaded members extends from each wall members;

attaching each wall member, by adhesive bonding, to an adjacent wall member for defining an elongated hollow core enclosed by said wall members, said threaded members extending transversely into said core;

drying said adhesively bonded wall members;

inserting at least one elongated metal reinforcing member extending axially within said core;

placing said attached wall members in a vertical position; and pouring concrete to fill said core and to engage said threaded members and said reinforcing member.

11. The method of claim 10, wherein the threaded members are distributed in a regular pattern.

12. The method of claim 10, wherein the threaded members are distributed in a zigzag pattern.

13. The method of claim 10, wherein each of the walls comprises a flat element having a corner groove and tongue structure, the walls being interconnected at joints defined by the groove and tongue structure of mutually adjacent corners.

* * * * *

UNITED STATES PATENT AND TRADEMARK OFFICE

CERTIFICATE OF CORRECTION

PATENT NO. : 4,741,144

DATED : May 3, 1988

INVENTOR(S) : Andre Graffin

It is certified that error appears in the above-identified patent and that said Letters Patent is hereby corrected as shown below:

The title page should be deleted to appear as per attached title page. The sheet of Drawing containing Figures 1-2 should be deleted to be replaced with Figures 1-3 as shown on the attached sheets.

United States Patent [19]

Graffin

[11] Patent Number: 4,741,144

[45] Date of Patent: May 3, 1988

[54] COMPOSITE STRUCTURAL BEAM

[76] Inventor: Andre Graffin, Le Tremblay-Omonville, 27110, Le Neubourg, France

[21] Appl. No.: 922,467

[22] Filed: Oct. 23, 1986

[30] Foreign Application Priority Data

Oct. 31, 1985 [FR] France ..... 85 16179

[51] Int. Cl.[4] ..... E04C 3/34; E04C 3/20

[52] U.S. Cl. ..... 52/725; 52/423; 52/724; 52/727; 52/741

[58] Field of Search ..... 52/724, 725, 727, 372, 52/423, 425, 741

[56] References Cited

U.S. PATENT DOCUMENTS

| | | | |
|---|---|---|---|
| 250,878 | 12/1981 | Brush . | |
| 1,533,099 | 4/1925 | Carroll . | |
| 1,792,040 | 2/1931 | Schaub | 52/372 X |
| 3,304,674 | 2/1967 | Ward | 52/425 X |
| 3,634,990 | 1/1972 | Pugh . | |
| 4,503,648 | 3/1985 | Mahaffey . | |

FOREIGN PATENT DOCUMENTS

| | | | |
|---|---|---|---|
| 0051319 | 5/1982 | European Pat. Off. . | |
| 0062139 | 10/1982 | European Pat. Off. . | |
| 111103 | 6/1900 | Fed. Rep. of Germany | 52/372 |
| 2226323 | 8/1973 | Fed. Rep. of Germany . | |
| 2931162 | 2/1981 | Fed. Rep. of Germany . | |
| 348209 | 4/1905 | France . | |
| 893659 | 8/1944 | France . | |
| 2479877 | 10/1981 | France . | |
| 2485594 | 12/1981 | France . | |
| 210311 | 7/1940 | Switzerland . | |

*Primary Examiner*—Alfred C. Perham

*Attorney, Agent, or Firm*—Burns, Doane, Swecker & Mathis

[57] ABSTRACT

Composite beam of polygonal cross-section comprises wooden external walls and a core of a material, such as concrete, providing the beam with its mechanical strength. The walls comprise flat elements assembled by means of bonded groove and tongue corner joints. Screws are embedded partially in the walls and partially in the core to bond the walls to the core.

13 Claims, 2 Drawing Sheets

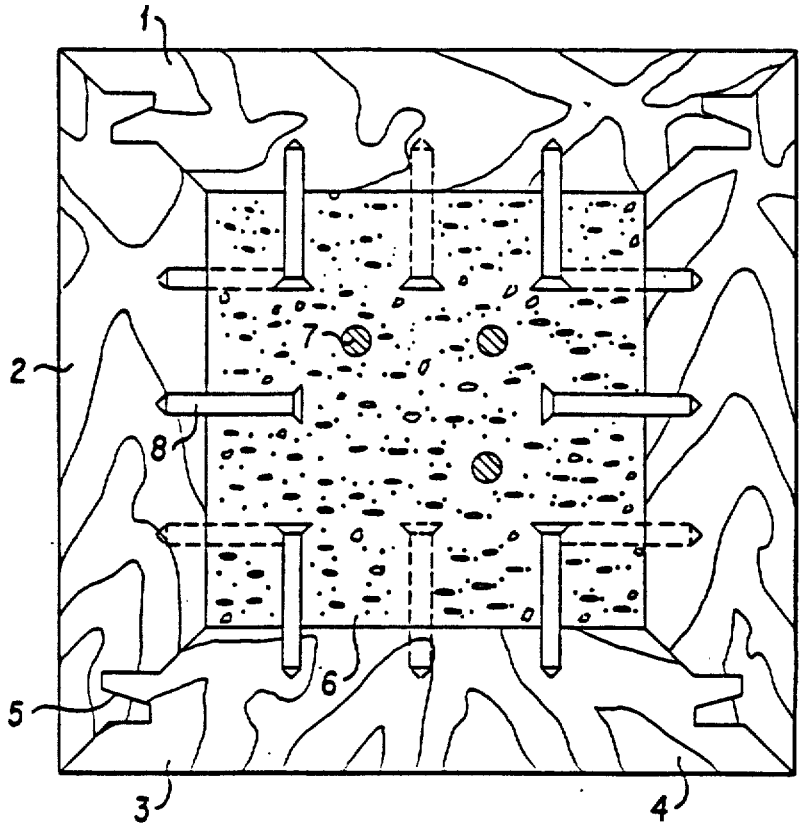

UNITED STATES PATENT AND TRADEMARK OFFICE

CERTIFICATE OF CORRECTION

PATENT NO. : 4,741,144

DATED : May 3, 1988

INVENTOR(S) : ANDRE GRAFFIN

It is certified that error appears in the above-identified patent and that said Letters Patent is hereby corrected as shown below:

FIG. 1

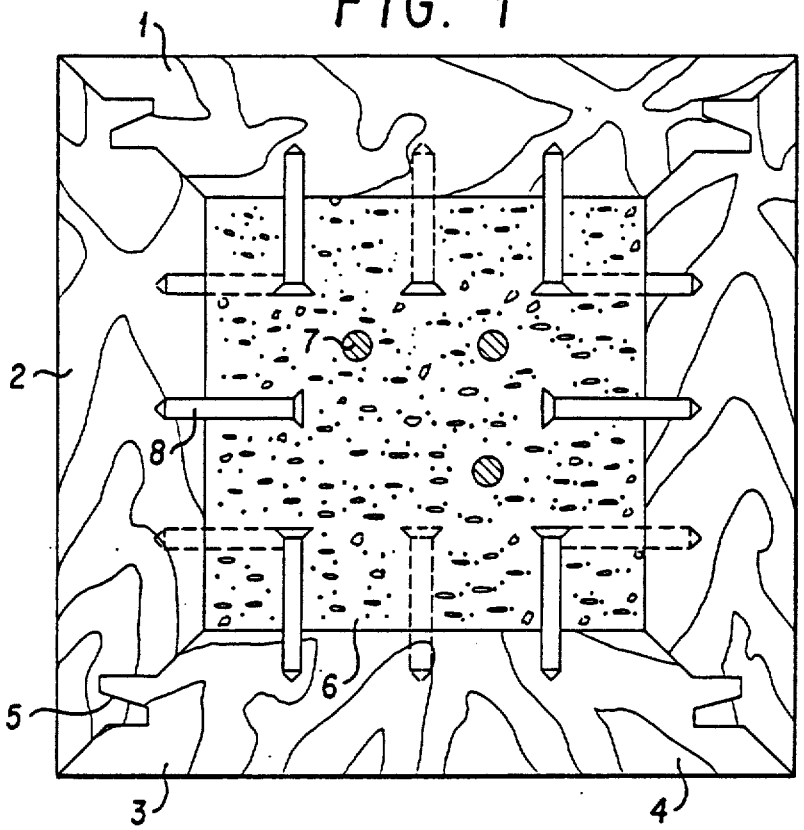

UNITED STATES PATENT AND TRADEMARK OFFICE

CERTIFICATE OF CORRECTION

PATENT NO. : 4,741,144

DATED : May 3, 1988

INVENTOR(S) : ANDRE GRAFFIN

It is certified that error appears in the above-identified patent and that said Letters Patent is hereby corrected as shown below:

FIG. 2

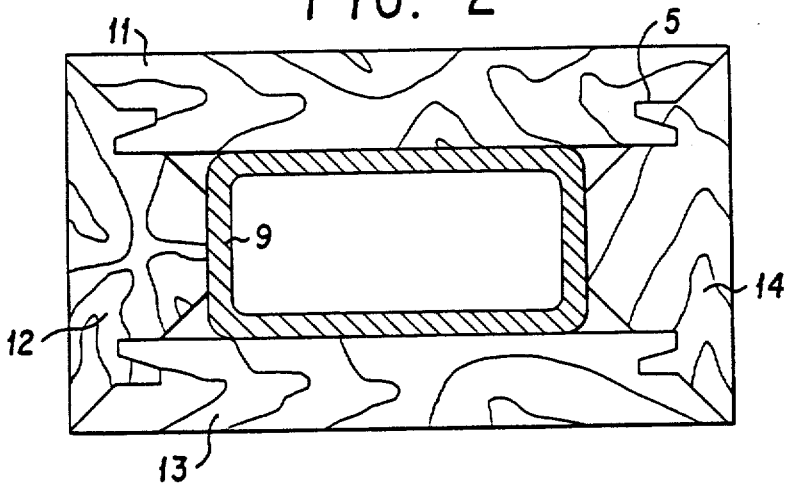

UNITED STATES PATENT AND TRADEMARK OFFICE

CERTIFICATE OF CORRECTION

PATENT NO. : 4,741,144

DATED : May 3, 1988

INVENTOR(S) : ANDRE GRAFFIN

It is certified that error appears in the above-identified patent and that said Letters Patent is hereby corrected as shown below:

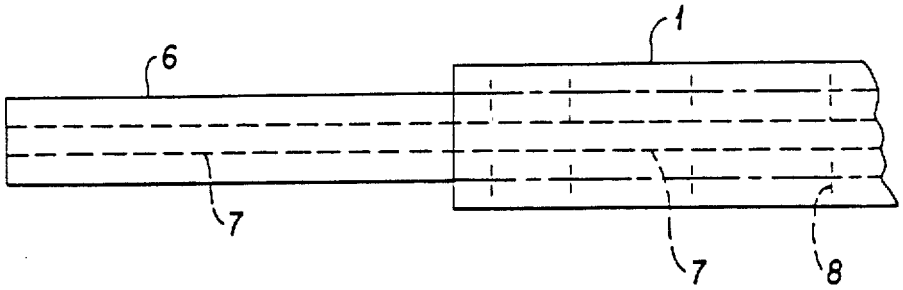

FIG. 3

Signed and Sealed this

Eighteenth Day of October, 1988

*Attest:*

DONALD J. QUIGG

*Attesting Officer*

*Commissioner of Patents and Trademarks*